US005083733A

United States Patent [19]

Marino et al.

[11] Patent Number: 5,083,733

[45] Date of Patent: Jan. 28, 1992

[54] BRUSH HOLDING DEVICE

[75] Inventors: Frank Marino; Steven W. Marino, both of Baldwin, N.Y.

[73] Assignee: Frank Marino Consulting, Inc., Baldwin, N.Y.

[21] Appl. No.: 638,751

[22] Filed: Jan. 7, 1991

[51] Int. Cl.[5] ..... A46B 17/02

[52] U.S. Cl. ..... 248/110; 248/206.5; 248/309.4

[58] Field of Search ..... 248/110, 111, 112, 113, 248/683, 206.5, 309.4, 213.2; 211/65; 220/90

[56] References Cited

U.S. PATENT DOCUMENTS

| | | | |
|---|---|---|---|
| 2,625,299 | 1/1953 | Uhlig | 248/110 X |
| 3,425,012 | 1/1969 | Gottinger | 248/309.4 X |
| 3,729,158 | 4/1973 | Nagy | 248/110 |
| 4,101,046 | 7/1978 | Puntillo | 248/110 X |
| 4,275,818 | 6/1981 | Church | 248/110 X |
| 4,377,239 | 3/1983 | Jimae | 248/110 X |
| 4,890,353 | 1/1990 | Shannon et al. | 248/110 X |
| 4,991,803 | 2/1991 | Buder | 248/213.2 X |

*Primary Examiner*—Ramon O. Ramirez
*Attorney, Agent, or Firm*—Daniel Jay Tick

[57] ABSTRACT

A clamp clamping a side of a container has a head portion and a pair of leg portions extending from the head portion and partially abutting opposite surfaces of the side of the container when in use. The head portion has support part angularly inclined to the leg portions. A first permanent magnet is mounted on the support part of the head portion in a manner whereby the magnet releasably holds a brush via the magnetic metal part of the brush over the lip of the container with the bristles of the brush over the open container and sloped downward from the handle of the brush, so that liquid on the bristles will drip into the container without befouling any of the brush, the container, or the proximate area of the container. A second permanent magnet is mounted on one of the leg portions of the clamp in a manner whereby the second magnet magnetically couples the clamp to a magnetic metal container.

12 Claims, 1 Drawing Sheet

BRUSH HOLDING DEVICE

BACKGROUND OF THE INVENTION

The present invention relates to a brush holding device. More particularly, the invention relates to a paint brush holding device, especially adapted to hold a wet paint brush.

When a person is in the midst of painting or applying any liquid material by brush and wishes to put his brush down for a moment or interrupt his activity for a short time, he must set down his paint brush. This creates the problems of keeping the brush from foreign matter which may pollute the paint or liquid material and preventing the befouling of the container of the paint or liquid and the proximate area of the container. The user of the paint brush or other type of liquid brush will most likely place the wet brush on the ground, or on a piece of paper, or wood, or balance said brush precariously on the rim or lip of the container. More often than not the brush will pick up dirt and debris via the paint on its bristles, or will stick to the paper or wood on which it is placed, and will foul, dirty, or spot the container and/or the proximate area of said container with the paint or liquid. This results in annoyance and extra expenditure of time and energy in cleaning the brush and/or the container and/or the proximate area of said container.

The principal object of the invention is to provide a brush holding device for supporting a brush.

An object of the invention is to provide a brush holding device of simple structure for releasably supporting a brush in a manner whereby liquid on the bristles of the brush will not befoul, pollute, or dirty a container of such liquid, the proximate area of the container, or the brush.

Another object of the invention is to provide a brush holding device of simple structure which is mountable on and removable from a container with facility, convenience and rapidity.

Still another object of the invention is to provide a brush holding device of simple structure for releasably supporting a paint brush in an efficient, effective and reliable manner whereby paint on the bristles of the brush will not befoul, pollute, or dirty the paint can, the proximate area of the paint can, or the paint brush.

Yet another object of the invention is to provide a brush holding device which is easily mountable on and removable from a paint can and supports a paint brush in a manner whereby paint on the bristles of the brush will not befoul or dirty the brush, the paint can, or the proximate area of the paint can.

BRIEF SUMMARY OF THE INVENTION

In accordance with the invention, a brush holding device for supporting a brush having a handle, bristles and a magnetic metal part comprises a clamp for clamping a side of a container having a lip. The clamp has a head portion and a pair of leg portions extending from the head portion and substantially partially abutting opposite surfaces of a side of the container when in use. The head portion has a support part angularly inclined to the leg portions. A permanent magnet is mounted on the support part of the head portion in a manner whereby the magnet releasably holds a brush via the magnetic metal part of the brush over the lip of the container with the bristles of the brush over the open container and sloped downward from the handle of the brush, so that liquid on the bristles will drip into the container without befouling any of the brush, the container and the proximate area of the container.

An additional permanent magnet is mounted on one of the leg portions of the clamp in a manner whereby the additional magnet magnetically couples the clamp to a magnetic metal container.

One of the leg portions of the clamp is of substantially S band configuration having a lower curved portion adapted to abut an inside surface of the side of the container and the other of the leg portions of the clamp is of substantially planar band configuration. The support part of the head portion is inclined at an angle of approximately 45° with the other of the leg portions and slopes into the container.

An additional permanent magnet is mounted on the other of the leg portions of the clamp in a manner whereby the additional magnet magnetically couples the clamp to an outside surface of the side of a magnetic metal container.

The one of the leg portions has an upper curved portion and the other of the leg portions has an upper inclined portion which joins the upper curved portion of the one of the leg portions and forms the head portion over the lip of the container and substantially in the space above the container whereby a brush held on the support part of the head portion will slope downward with its bristles in the space above the container.

In accordance with the invention, a brush holding device for supporting a paint brush having a handle, bristles and a magnetic metal part comprises a clamp for clamping a side of a container having a lip. The clamp has a head portion and a pair of leg portions extending from the head portion and substantially partially abutting opposite surfaces of a side of the container when in use. The head portion has a support part angularly inclined to the leg portions. A permanent magnet is mounted on the support part of the head portion in a manner whereby the magnet releasably holds a paint brush via the magnetic metal part of the brush over the lip of the container with the bristles of the paint brush over the open container and sloped downward from the handle of the brush, so that paint on the bristles will drip into the container without befouling any of the paint brush, the container and the proximate area of the container.

An additional permanent magnet is mounted on one of the leg portions of the clamp in a manner whereby the additional magnet magnetically couples the clamp to a magnetic metal container.

One of the leg portions of the clamp is of substantially S band configuration having a lower curved portion adapted to abut an inside surface of the side of the container and the other of the leg portions of the clamp is of substantially planar band configuration. The support part of the head portion is inclined at an angle of approximately 45° with the other of the leg portions and slopes into the container.

An additional permanent magnet is mounted on the other of the leg portions of the clamp in a manner whereby the additional magnet magnetically couples the clamp to an outside surface of the side of a magnetic metal container.

The one of the leg portions has an upper curved portion and the other of the leg portions has an upper inclined portion which joins the upper curved portion of the one of the leg portions and forms the head portion over the lip of the container and substantially in the space above the container whereby a paint brush held on the support part of the head portion will slope downward with its bristles in the space above the container.

The container is most often a paint can.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENT

The brush holding device of the invention supports a brush 1 (FIGS. 2 and 3) having a handle 2, bristles 3 and a magnetic metal part or ferrule 4. The brush 1 may be any brush of the type described such as, for example, a paint brush.

Figure 1:
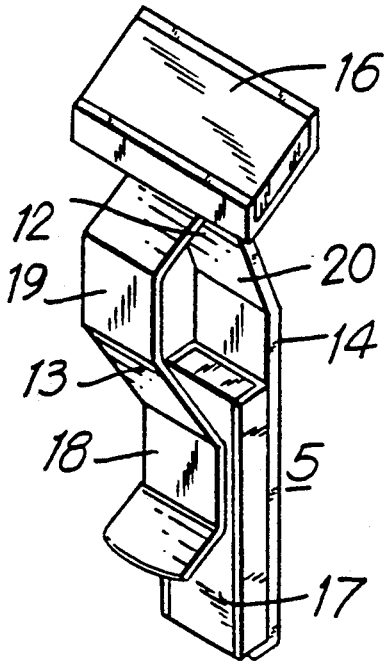
FIG. 1 is a perspective view of an embodiment of the brush holding device of the invention.
Figure 2:
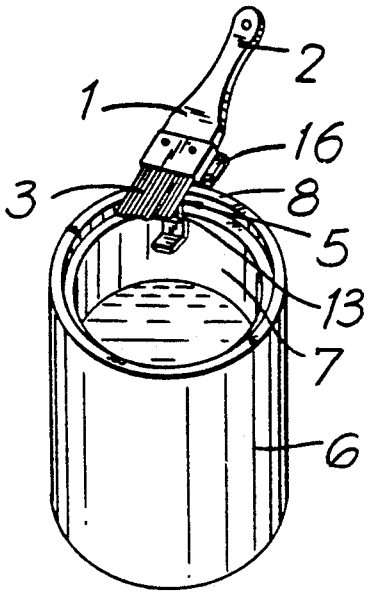
FIG. 2 is a perspective view, on a reduced scale, of the embodiment of the FIG. 1 in use, mounted on a paint can.
Figure 3:
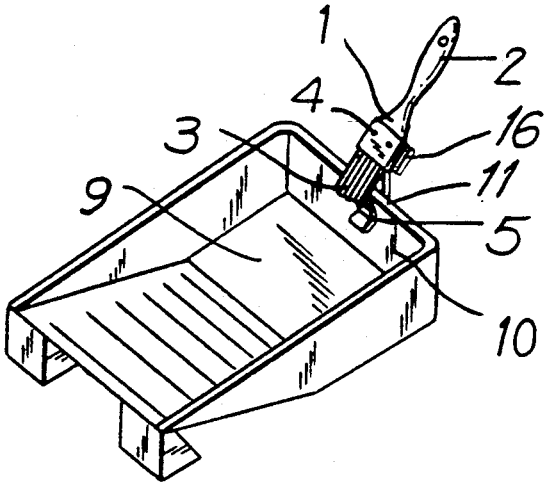
FIG. 3 is a perspective view, on a reduced scale, of the embodiment of FIG. 1 in use, mounted on a paint tray.
Figure 4:
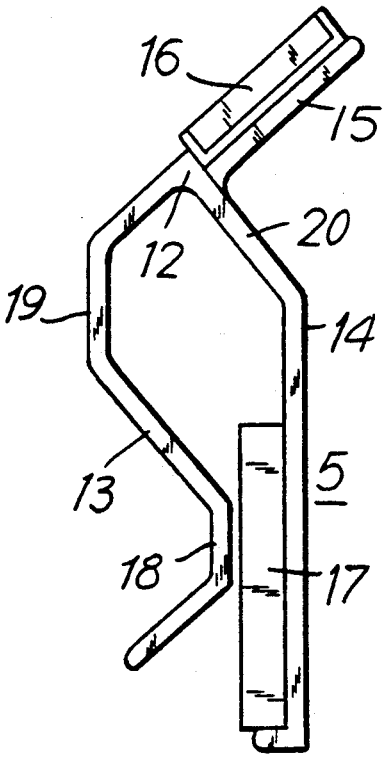
FIG. 4 is a side view, on an enlarged scale, of the embodiment of FIG. 1.

The brush holding device of the invention comprises a clamp 5, as shown in FIGS. 1 and 4, for clamping a side of a container having a lip. Thus, the container may consist of a paint can 6, for example, having a side 7 clamped by the clamp 5 and a lip 8, as shown in FIG. 2, or a paint tray 9, for example, having a side 10 clamped by the clamp 5 and a lip 11, as shown in FIG. 3. The container 6 or 9 may contain any liquid being dispersed by a user via the brush 1.

The clamp 5 of the invention, as shown in FIGS. 1 and 4, has a head portion 12 and a pair of leg portions 13 and 14 extending from said head portion and substantially partially abutting opposite surfaces of the side 7 or 10 of the container 6 or 9, respectively, when in use. The head portion 12 has a support part 15 angularly inclined to the leg portions 13 and 14, as shown in FIG. 4.

A first permanent magnet 16 (FIGS. 1 and 4) is mounted on the support part 15 of the head portion 12 of the clamp 5 in a manner whereby said magnet releasably holds the brush 1, via the magnetic metal part 4 of said brush, over the lip 8 or 11 of the container 6 or 9, respectively, with the bristles 3 of said brush over the open container and sloped downward from the handle 2 of said brush, as seen in FIGS. 2 and 3. This results in paint or any liquid on the bristles 3 of the brush 1 dripping into the container 6 or 9 without befouling said brush, said container, or the proximate area of said container.

A second permanent magnet 17 (FIGS. 1 and 4) is mounted on the leg 14 of the clamp 5 in a manner whereby said second magnet magnetically couples said clamp to the container 6 or 9, if such container consists of a magnetic material.

The leg portion 13 of the clamp 5 is of substantially S band configuration (FIGS. 1 and 4) having a lower curved portion 18 adapted to abut the inside surface of the side 7 or 10 of the container 6 or 9, respectively, and an upper curved portion 19, as shown in FIGS. 1 and 4.

The leg portion 14 of the clamp 5 is of substantially planar band configuration (FIGS. 1 and 4) and has an upper inclined portion 20 which joins the upper curved portion 19 of the leg portion 13, is shown in FIG. 4, and forms the head portion 12 over the lip 8 or 11 of the container 6 or 9, respectively, and substantially in the space above said container.

The support part 15 of the head portion 12 is inclined at an angle of approximately 45° with the leg portion 14 and slopes into the container 6 or 9. Thus, a brush 1 held on the support part 15 of the head portion 12 will slope downward with its bristles 3 in the space above the container 6 or 9. This keeps the brush 1 free from foreign matter on the ground and insures that any excess paint or other liquid on the bristles 3 of said brush will drip into the container 6 or 9, rather than on said container or anywhere bordering said container.

Although shown and described in what is believed to be the most practical and preferred embodiment, it is apparent that departures from the specific device or design described and shown will suggest themselves to those skilled in the art and may be made without departing from the spirit and scope of the invention. We, therefore, do not wish to restrict ourselves to the particular construction described and illustrated, but desire to avail ourselves of all modifications that may fall within the scope of the appended claims.

We claim:

1. A brush holding device for supporting a brush having a handle, bristles and a magnetic metal part, said brush holding device comprising clamp means for clamping a side of a container having a lip, said clamp means having a head portion and a pair of leg portions extending from said head portion and partially abutting opposite surfaces of a side of said container beneath said lip when in use, said head portion having a support part angularly inclined to said leg portions, one of the leg portions of said clamp means being of substantially curvilinear configuration having a lower curved portion adapted to abut an inside surface of said side of said container and the other of said leg portions of said clamp means being of substantially planar band configuration, said support part of said head portion being inclined at an angle with said other of said leg portions and sloping into said container; and a permanent magnet mounted on the support part of said head portion in a manner whereby said magnet releasably holds said brush via the magnetic metal part of said brush over the lip of said container with the bristles of said brush over the open container and sloped downward from the handle of said brush, so that liquid on said bristles will drip into said container without befouling any of said brush, said container and the proximate area of said container.

2. A brush holding device as claimed in claim 1, further comprising an additional permanent magnet mounted on said other of said leg portions of said clamp means in a manner whereby said additional magnet magnetically couples said clamp means to an outside surface of said side of a magnetic metal container.

3. A brush holding device as claimed in claim 1, wherein said one of said leg portions has an upper curved portion and said other of said leg portions has an upper inclined portion which joins said upper curved portion of said one of said leg portions and forms said head portion over the lip of said container and substantially in the space above said container, whereby a brush held on said support part of said head portion will slope downward with its bristles in said space above said container.

4. A brush holding device for supporting a paint brush having a handle, bristles and a magnetic metal part, said brush holding device comprising clamp means for clamping a side of a container having a lip, said clamp means having a head portion and a pair of leg portions extending from said head portion and partially abutting opposite surfaces of a side of said container beneath said lip when in use, said head portion having a support part angularly inclined to said leg portions, one of the leg portions of said clamp means being of substantially curvilinear configuration having a lower curved portion adapted to abut an inside surface of said side of said container and the other of said leg portions of said clamp means being of substantially planar band configuration, said support part of said head portion being inclined at an angle with said other of said leg portions and sloping into said container; and a permanent magnet mounted on the support part of said head portion in a manner whereby said magnet releasably holds said paint brush via the magnetic metal part of said brush over the lip of said container with the bristles of said paint brush over the open container and sloped downward from the handle of said brush, so that paint on said bristles will drip into said container without befouling any of said paint brush, said container and the proximate area of said container.

5. A brush holding device as claimed in claim 4, further comprising an additional permanent magnet mounted on said other of said leg portions of said clamp means in a manner whereby said additional magnet magnetically couples said clamp means in a manner whereby said additional magnet magnetically couples said clamp means to an outside surface of said side of a magnetic metal container.

6. A brush holding device as claimed in claim 4, wherein said one of said leg portions has an upper curved portion and said other of said leg portions has an upper inclined portion which joins said upper curved portion of said one of said leg portions and forms said head portion over the lip of said container and substantially in the space above said container, whereby a paint brush held on said support part of said head portion will slope downward with its bristles in said space above said container.

7. A brush holding device for supporting a brush having a handle, bristles and a magnetic metal part, said brush holding device comprising clamp means for clamping a side of a container having a lip, said clamp means having a head portion and a pair of leg portions extending from said head portion and partially abutting opposite surfaces of a side of said container when in use, said head portion having a support part angularly inclined to said leg portions, one of said leg portions being of substantially S band configuration having a lower curved portion adapted to abut an inside surface of said side of said container, the other of said leg portions being of substantially planar band configuration and said support part of said head portion being inclined at an angle of approximately 45° with said other of said leg portions and sloping into said container; and a permanent magnet mounted on the support part of said head portion in a manner whereby said magnet releasably holds said brush via the magnetic metal part of said brush over the lip of said container with the bristles of said brush over the open container and sloped downward from the handle of said brush, so that liquid on aid bristles will drip into said container without befouling any of said brush, said container and the proximate area of said container.

8. A brush holding device as claimed in claim 7 further comprising an additional permanent magnet mounted on said other of said leg portions of said clamp means in a manner whereby said additional magnet magnetically couples said clamp means to an outside surface of said side of a magnetic metal container.

9. A brush holding device as claimed in claim 7, wherein said one of said leg portions has an upper curved portion and said other of said leg portions has an upper inclined portion which joins said upper curved portion of said one of said leg portions and forms said head portion over the lip of said container and substantially in the space above said container, whereby a brush held on said support part of said head portion will slope downward with its bristles in said space above said container.

10. A brush holding device for supporting a paint brush having a handle, bristles and magnetic metal part, said brush holding device comprising claim means for clamping a side of a container having a lip, said clamp means having a head portion and a pair of leg portions extending from said head portion and partially abutting opposite surfaces of a side of said container when in use, said head portion having a support part angularly inclined to said leg portions, one of said leg portions being of substantially S band configuration having a lower curved portion adapted to abut an inside surface of said side of said container, the other of said leg portions being of substantially planar band configuration and said support part of said head portion being inclined at an angle of approximately 45° with said other of said leg portions and sloping into said container; and a permanent magnet mounted on the support part of said head portion in a manner whereby said magnet releasably holds said paint brush via the magnetic metal part of said brush over the lip of said container with the bristles of said paint brush over the open container and sloped downward from the handle of said brush, so that paint on said bristles will drip into said container without befouling any of said paint brush, said container and the proximate area of said container.

11. A brush holding device as claimed in claim 10, further comprising an additional permanent magnet mounted on said other of said leg portions of said clamp means in a manner whereby said additional magnet magnetically couples said clamp means in a manner whereby said additional magnet magnetically couples said clamp means to an outside surface of said side of a magnetic metal container.

12. A brush holding device as claimed in claim 10, wherein said one of said leg portions has an upper curved portion and said other of said leg portions has an upper inclined portion which joins said upper curved portion of said one of said leg portions and forms said head portion over the lip of said container and substantially in the space above said container, whereby a paint brush held on said support part of said head portion will slope downward with its bristles in said space above said container.

* * * * *